United States Patent [19]

Winslow

[11] Patent Number: 4,753,321

[45] Date of Patent: Jun. 28, 1988

[54] TRAVELING WORKER PLATFORM

[75] Inventor: Lee B. Winslow, Orlando, Fla.

[73] Assignee: Benjamin E. Price, Longwood, Fla.

[21] Appl. No.: 51,579

[22] Filed: May 18, 1987

[51] Int. Cl.[4] ..... E04G 3/10

[52] U.S. Cl. ..... 182/145; 182/150; 182/39

[58] Field of Search ..... 182/145, 150, 141–144, 182/146–148, 36, 37, 39, 101–103, 187, 112, 147; 248/82

[56] References Cited

U.S. PATENT DOCUMENTS

| | | | |
|---|---|---|---|
| 1,101,984 | 6/1914 | Barret | 248/82 |
| 2,164,519 | 7/1939 | Hayner | 182/145 |
| 2,984,198 | 5/1961 | Atkinson et al. | 248/82 X |
| 3,101,127 | 8/1963 | Fouger | 182/112 X |
| 3,111,764 | 11/1963 | Mayes | 182/147 X |

FOREIGN PATENT DOCUMENTS

| | | | |
|---|---|---|---|
| 672 | 8/1977 | Fed. Rep. of Germany | 182/145 |

*Primary Examiner*—Alvin C. Chin-Shue

*Attorney, Agent, or Firm*—Duckworth, Allen, Dyer & Doppelt

[57] ABSTRACT

A worker platform for sandblasting a cylindrical fuel storage tank includes a lookout frame section secured to the tank top that has an arm extending radially outward beyond the tank wall and a roller assembly supporting the arm for circumferential movement about the tank. A stage is suspended by a winch from the arm, and a square cross-sectioned standpipe is captured within upper and lower square guide channels formed at the center of the stage and by a yoke at the outer extent of the arm. The standpipe has a base plate with projections or spikes to penetrate the ground. The winch moves the stage up and down with the standpipe passing vertically through the guide channels and providing stability against swinging, twisting and tilting. For circumferential movement, a pin temporarily locks the standpipe for lifting with the stage. Lookout frame embodiments are given for both solid and floating tank tops.

22 Claims, 2 Drawing Sheets

TRAVELING WORKER PLATFORM

This invention relates to worker platforms and scaffolding in general; and, in particular, to a traveling worker platform having improved stability against swinging, twisting and tilting.

BACKGROUND OF INVENTION

Platforms and scaffolding are used for a variety of purposes including painting, welding and sandblasting. The construction of such devices differs for different applications and for different buildings or other structures with which they are to be used. Worker platforms for cylindrical fuel storage tanks and the like are typically vertically adjustable block and tackle arrangements with some provision being made for moving the platform around the tank. Examples of traveling devices for positioning workers adjacent storage tanks and similar structures are given in U.S. Pat. Nos. 1,101,839; 1,421,609; 3,114,433; 3,537,545; and 3,837,429.

Conventional traveling platforms for positioning workers at convenient stations about storage tanks have framework in the form of a boom or arm that is secured to the top center of the tank and extends radially outward across the top to a point beyond the sidewall of the tank. A stage made up of planking or similar materials is suspended by a block and tackle arrangement from the outer end of the arm. The block and tackle fitting provides selective vertical positioning. A carrier wheel or other rolling mechanism supports the arm for travel about the periphery of the tank top. The wheel provides selective circumferential positioning and, together with the block and tackle fitting, enables a worker to be positioned at any number of locations about the tank. Such traveling worker platforms are particularly useful in connection with performing construction and maintenance operations on fuel storage tanks which are surrounded by fire and spill retention walls that limit the use of ground supported devices.

A problem with the conventional block and tackle structures is, however, their instability. This is especially troublesome for operations such as sandblasting where high pressure hose nozzles must be manipulated. There is a tendency for the whole stage to swing or sway outwardly in pendulum fashion away from the tank when pressure is applied and for the ends of the stage to twist or swivel vertically about its center. Difficulty may also be encountered in keeping the stage floor level, preventing its tilting or leaning either forward or backward, or to one end. This lack of stability restricts the sandblasting procedure and may also interfere with high volume paint spraying.

SUMMARY OF THE INVENTION

The present invention provides a traveling worker platform for positioning a worker at selected locations about the outside of a storage tank that offers increased stability and is especially useful for sandblasting operations.

The worker platform of the present invention has a worker stage suspended in cantilever fashion from the outer end of a radially extending lookout arm mounted for movement about the top of a storage tank. Roller means is provided to support the arm and to roll it around the periphery of the tank. A standpipe extending in rail-like fashion in guideways between the stage and the outer end of the traveling arm provides releasable anchoring to footing at the base of the tank and restrains the stage against swinging, twistig and tilting.

In a preferred form of the invention, described in greater detail below, the standpipe takes the form of a column of square cross-section slidably captured in correspondingly-shaped guideways on the stage and arm. A ground penetrating footing plate is carried by the standpipe, and means is provided to raise and lower the standpipe so that anchoring can be released during circumferential repositioning of the work station.

To meet the special needs of high pressure, high volume sandblasting operations, the described stage is outfitted at each end with universal movable sandblast nozzle mounts and hose retaining fixtures. Emobdiments of the lookout arm are described for both fixed and floating top storage tanks.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENT

Figure 1:
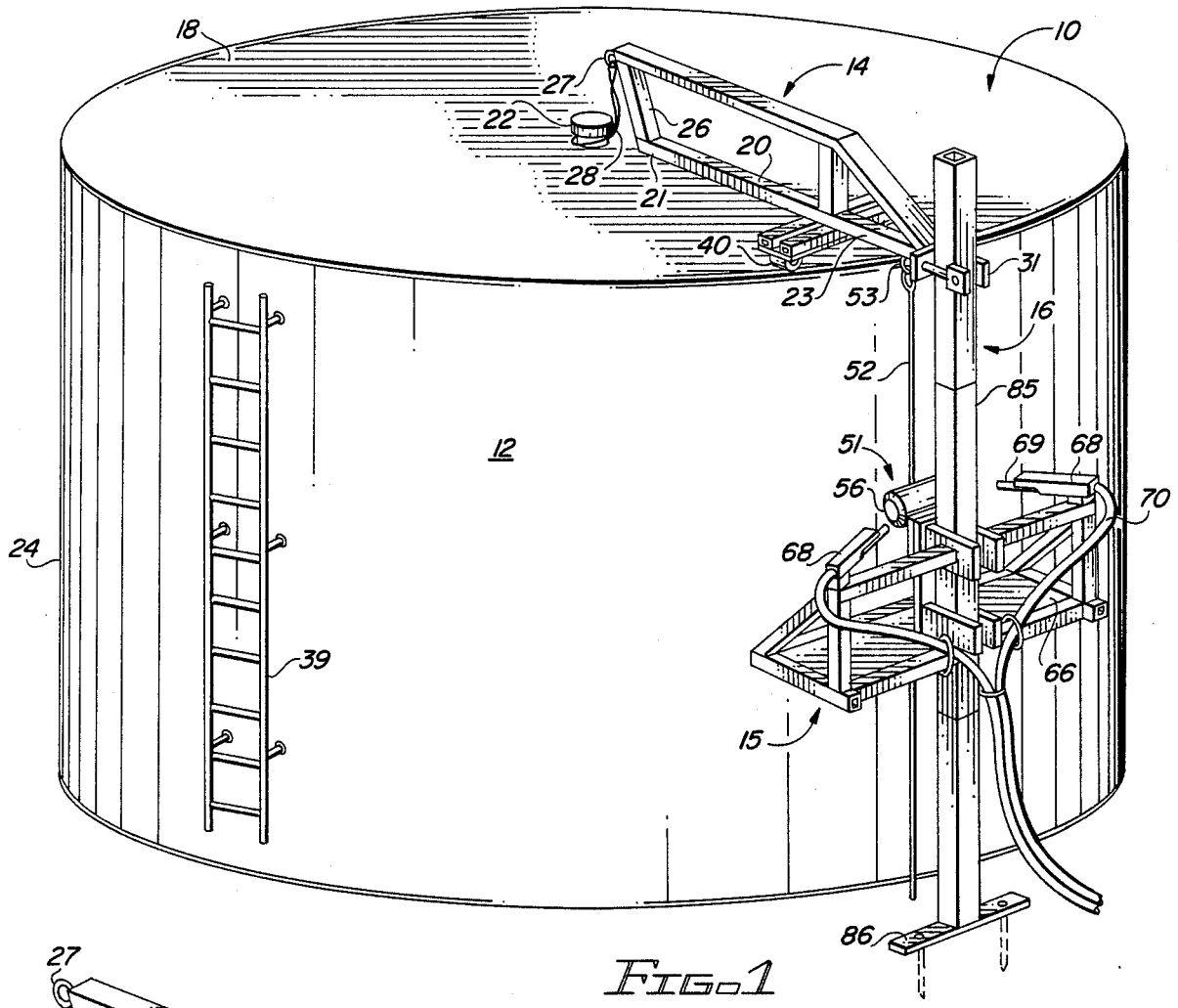
FIG. 1 is an overall perspective view of an example of a traveling worker platform constructed in accordance with the principles of the invention.

FIG. 1 shows an example of a traveling worker platform 10 constructed in accordance with the principles of the present invention and utilized to position a worker at selected work station positions adjacent a cylindrical fuel storage tank 12.

The platform 10 comprises a lookout section 14, a stage section 15 and a standpipe section 16. For use with a fixed tank top 18, such as shown in FIG. 1, the lookout 14 is a frame structure as detailed in FIG. 2. An arm or boom 20 is dimensioned and configured to extend radially outward across the tank top 18, from an inner end 21 (FIG. 2) facing a pole or post 22 at the center of the top 18 (FIG. 1) to an outer end 23 projecting beyond the top edge of the tank and overhanging a tank wall 24. The arm 20 may be suitably formed from 2″×2″ hollow steel tubing. At its inner end 21, a back piece 26 is welded to extend upwardly and inwardly from the top of the arm 20. A shoulder-type eyebolt 27 positioned at an elevated point on the lookout back 26 serves as a convenient means of securing the lookout section 14 to the central post 22. Attachment can be established between the eyebolt 27 and the post 22 by means such as a ⅜" metal cable 28 fastened around the post 22 with cable clamps.

Figure 2:
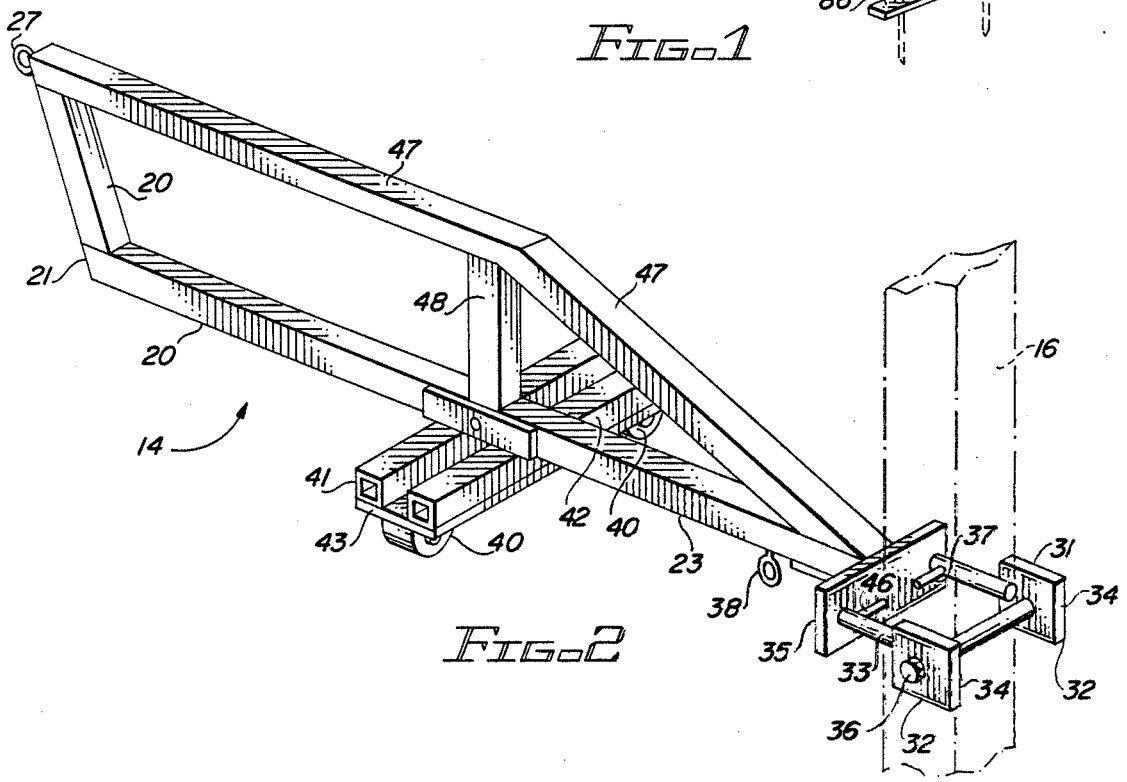
FIG. 2 is a perspective view of the lookout section of the platform of FIG. 1.

At the outer end 23 of the arm 20, a bifurcated yoke 31 is fitted to provide a guideway for the standpipe 16 (whose position is indicated by dot-and-dashes in FIG. 2). The yoke 31 has two spaced-apart sides 32 extending parallel to the arm 20 and joined to the outer ends of a cross-piece 35 connected perpendicularly to the arm 20. The sides 32 are formed with aligned openings through which a bolt 36 is removably inserted in order to retain the standpipe 16 within the yoke 31. An inwardly positioned pin 37 welded between the sides 32 serves as an inner stop for the standpipe 16. The spacing between the bolt 36 and pin 37 is set to slidably capture the standpipe 16. Pin 37 is cut out at its center to permit passage of bolts that connect sections of the standpipe 16, as further described below.

The sides 32 are advantageously formed with solid rounded pieces 33 between the positions of bolt 36 and pin 37 to permit receiving the standpipe 16 at an angle slightly off center to overcome alignment problems between the lookout yoke 31 and standpipe receiving portions of the stage 15. Flat bar members 34 welded at the outer end of the rounded pieces 33 provide parallel platforms for the aligned holes through which the bolt 36 can pass. A metal spacer 46 may be welded between the pin 37 and the piece 35.

Another eyebolt 38 is located in downward facing position ahead of the yoke 31 on the underside of the outer end 23 of arm 20. The eyebolt 38 serves as the attachment point for the suspension from the lookout 14 of the stage 15. The location of eyebolt 38 is thus at a point beyond the top edge of the tank 12. The extent of projection of the arm 20 beyond the rim of the tank top 18 and the positioning of the eyebolt 38 are chosen to give a sufficient clearance between the stage 15 and the sidewall 24 to permit the platform 10 to clear any obstacles during its traversal of the tank 12. Three feet is a suitable clearance for avoiding an object such as a ladder 39 (FIG. 1).

Means, in the form of wheels or casters 40, is provided on the arm 20 intermediate its ends 21, 23 to support the weight of the stage 15 suspended from eyebolt 38 and to permit the outer end 23 of arm 20 to be moved circumferentially about the tank top 18. As shown in FIGS. 1 and 2, two wheels 40 are mounted in positions equally spaced from arm 20, tangentially of the top 18, for rotary movement along an arcuate path about the periphery of the tank 12. Appropriate mounting to arm 20 includes two parallel lengths 41, 42 of 2"×2" hollow steel tubing held in fixed position by a steel plate stiffener 43 to the bottom of which wheels 40 in the form of heavy duty casters are affixed. The caster mounting assembly can be welded for permanent attachment to the arm 20. It is, however, considered advantageous to make the wheel assembly removable so that portability is increased. (This will be especially appreciated, for example, when the lookout section has to be carried up a 40 ft. ladder for assembly.) One way of achieving removability is shown in FIG. 2, wherein two brackets 44 are welded perpendicularly to the top of the tubing lengths 41, 42 in positions so that their facing surfaces provide a groove to fit in the intended position along the arm 20. The wheel assembly can then be fastened and unfastened from the arm 20 by a suitable fastening mechanism, such as a ½" threaded bolt 45 passing through aligned openings in the brackets 44 and arm 20.

The lookout framework 14 is strengthened by additional bracing structure extending from the eyebolt 27 end of the back 26 to the yoke 31 end of the arm 20. An example of such bracing is shown in FIG. 2 in which a 2"×¼" flat steel bar 47 runs from the top of the back 26 across a post 48, positioned at the point of attachment of the wheel assembly, and then angles down and bends around the end 23 between the arm 20 and the cross-piece 35 of the yoke 31. Permanent connections between the various elements of the lookout section 14 are suitably made by welding.

The stage 15 (FIGS. 1 and 3) is suspended for selective vertical positioning by conventional means from the eyebolt 38 of the lookout 14. This can be accomplished, as shown in FIG. 1, by use of a commercially available hoist or winch 51, such as a Skyclimber TM air motor winch, having a cable 52 connected by means of a shackle 53 to the eyebolt 38 and having a motor housing 56 connected to a suitable point of attachment, such as eyebolt 57, on the stage section 15.

Figure 3:
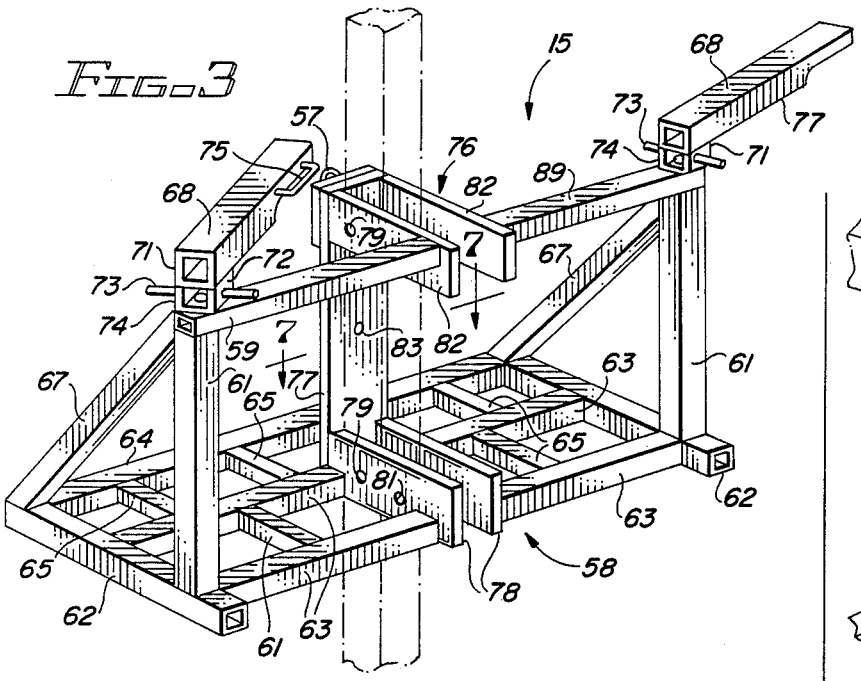
FIG. 3 is a perspective view of the stage section of the platform of FIG. 1.

Details of the stage section 15 are given in FIG. 3. The stage 15 serves as the rigid framework on which the workers can stand. As shown, the stage has a box-like configuration comprising a horizontal floor portion 58 and a guardrail 59 running along the outside of the stage 15 and raised above the floor portion 58 by means of corner posts or stanchions 61. The floor 58 comprises opposite end members 62 between which extend parallel runners 63, 64, periodically joined by intermediate cross braces 65. The flooring 58 of stage 15 is shown uncovered in FIG. 3. It may, however, be desirable to cover the same with plywood or other covering material to furnish a good worker standing surface 66, as shown in FIG. 1. Diagonal members 67 extend from the inside ends of members 62 to the top ends of stanchions 61. Additional structural bracing may be included, as desired. An appropriate arrangement of the stage elements 59–67 utilizes 2"×2" hollow steel tubing for the flooring elements 62–65 and 1"×1" hollow steel tubing for the rail 59, the posts 61 and the diagonal members 67. It should be appreciated that the configuration of the flooring 58 and of the guardrail 59 portions of the stage 15 may vary depending on the intended application and on individual preferences of the work crew.

The illustrated stage 15, configured for use in sandblasting operations on a 40-foot tall fuel storage tank 12, has an 8-foot length from end member 62 to end member 62 and can accommodate two workers side by side for sandblasting a 16-foot path down the side 24 of the tank 12. A mount 68 for a high pressure nozzle 69 (FIG. 1) of a sandblasting hose 70 is located on top of each stanchion 61 (FIG. 3). Each mount 68 consists of a hollow tubing section 71 joined to the rail 59 by a universal joint 72 similar to the connection of an oar to an oarlock on a rowing boat, providing rotational movement about the vertical axis of the post 61 and also about a horizontal axis provided by a pin 73 connected across the two upwardly extending sides of a "U"-shaped bracket 74. The tubing section 71 is pivotally attached at one end to the pin 73, and the base of the bracket 74 is rotationally attached to the rail 59 (see FIG. 3). The section 71 includes a cutback portion at the underside of its free end to facilitate attachment of the nozzles 69 to the pressure hoses 70. The pin 73 is extended to project from the sides of the bracket 74 to permit the hose 70 to be tied to the mount 69 (FIG. 1). The hoses 70 can also be tied to the stage floor 58, as shown in FIG. 1, to keep their weight off the mounts 68.

Sandblasting is achieved with a nozzle 69 held within the mount 68 and manipulated by moving the free end of the tubing section 71 up and down, and back and forth. This relieves the worker from having a fight the pressure, thereby giving greater control and safety. To make the movemnt of the mount 68 easier, a handle 75 (FIG. 3) is added to the tubing section 71.

To provide stabilization to the stage 15, a guide assembly 76 is provided at the center of the stage 15 into which the standpipe section 16 is slidably received for support. A backplate 77 extends vertically at the center of the stage 15 from the floor portion 58 to the height of the guardrail 59. Two spaced-apart guide plates 78 run outwardly in parallel at the lower end of the back plate 77 to the outer edge of the floor 58, forming a yoke similar to yoke 31 of lookout 14 (FIG. 2) into which the standpipe 16 (shown by dot-and-dashed lines in FIG. 3 and by solid lines in FIG. 7) fits. A pin 79, flash welded between aligned openings of the guide plates 78 (see FIG. 7), performs the function of a stop for the entry of the standpipe 16 between the plates 78. The pin 79 is cut out at its center after welding for reasons discussed below in connection with FIG. 5. A removable threaded bolt 81 brought between a second set of aligned openings in the guide plates 78 acts to retain the standpipe 16 in the channel formed between the two plates 78. The guide plates 78 are bonded to the runners 63 as shown. A like arrangement of guide plates 82 extends outwardly from the upper end of the backplate 77. The guide plates 82 are bonded to the guide rail sections 59, as shown.

Figure 7:
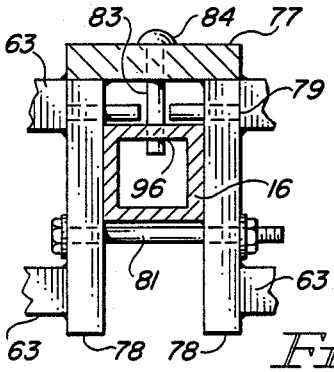
FIG. 7 is a section view corresponding to a view taken along the line 7—7 of FIG. 3.

The separate channels formed between the upper and lower guide plates are vertically aligned and the arrangement is such that entry of the standpipe 16 into the opening between each set of guide plates is unobstructed when the respective bolts 81 are removed (see FIG. 7). A bore 83 is provided in the backplate 77 for the temporary insertion of a locking pin 84 to secure the standpipe 16 to the stand 15 for raising it up with the winch 51 (FIG. 1) when the platform 10 is moved, as is further described below.

Figure 4:
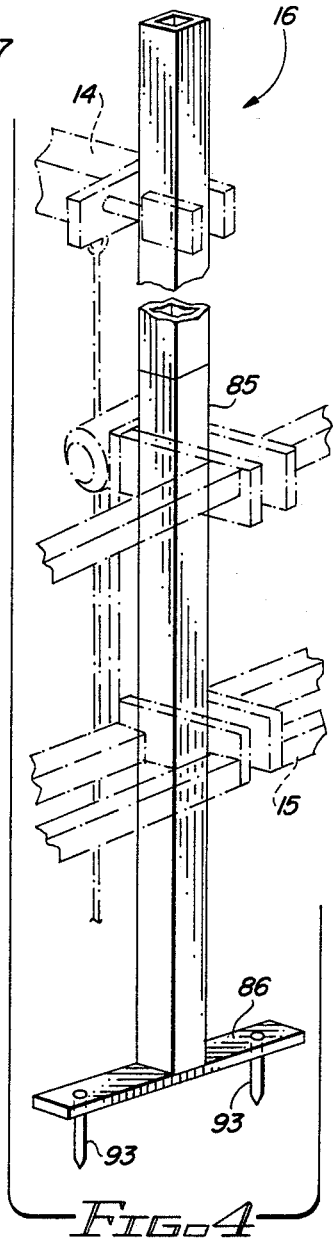
FIG. 4 is a perspective view of the standpipe section of the platform of FIG. 1.

Details of the standpipe section 16 are given in FIG. 4 which indicates in phantom outline the presence of the lookout 14 and stage 15. The function of the standpipe 16 is to cooperate with the yoke 31 of lookout 14 (FIG. 2) and with the guide assembly 76 (FIGS. 3 and 7) of stage 15 to provide stability to the stage during sandblasting or other work operations. Although it should be appreciated that stability can be achieved in accordance with the principles of the present invention by the use of other cross-sectional configurations for the standpipe section 16, the standpipe 16 (see FIGS. 1 and 4) preferably comprises a rectangular or square cross-sectional column 85 at the lower end of which is affixed a transversly extending horizontal baseplate 86, such as by welding.

Figure 5:
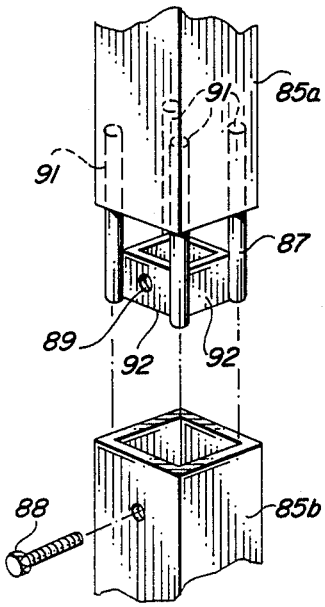
FIG. 5 is an exploded view showing the connection of adjacent sections of the standpipe of FIG. 4.

The column 85 may take the form of 3"×3" hollow steel tubing made up of a plurality of conveniently portable-length sections 85*a*, 85*b* assembled end-to-end as set forth in FIG. 5. An upper tubing section 85*a* is mated to a lower tubing section 85*b* by means of a sleeve 87 welded in the ends of one of the sections 85*a*, 85*b* for insertion into the facing end of the other section. A releasable connection between the sections 85*a*, 85*b* is achieved by threading a bolt 88 through an opening in the wall of the non-sleeved tubing section, into a nut 89 welded in a corresponding position in the sleeve 87. The configuration of sleeve 87, shown in FIG. 5, takes the form of ⅝" solid round rods 91 welded into each inside corner of the end of section 58*a* and joined at their lower extremities by a rectangular arrangement of 1½" flat bar pieces 92 arranged to give the sleeve 87 a slight inward taper for ease of insertion into the adjacent end of the section 85*b*. The various connections of the sections 85*a*, 85*b* of the column 85 are arranged so that the protruding heads of the bolts 88 will pass through the central openings of the pin 37 (FIG. 2) and pin 79 (FIGS. 3 and 7) of the standpipe channels provided respectively by the yoke 31 of lookout 14 and the guide plates 78, 82 of stand 15.

Figure 6:
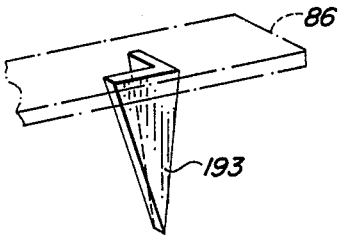
FIG. 6 is a perspective view of an alternative embodiment of the ground penetrating element of the standpipe of FIG. 4.

The base plate 86 (FIG. 4) includes a plurality of downwardly pointing projections 91 which are sharpened at their lower extents to penetrate the ground surrounding the tank 12 when the standpipe 16 is in its platform 10 anchoring position. An alternative to the projections 93 of FIG. 4 is shown in FIG. 6, wherein the projections take the form of spikes made of angle irons 191 which have been tapered to form ground penetrating points. It should be appreciated that the dimensions of the plate 86 and the type of projection 93 is selected to match the ground surface to which they will be applied.

A 40-foot fuel storage tank can be sandblasted with a traveling worker platform 10 of the illustrated design utilizing four sections 85*a*, 85*b* of 10-foot length each to make up the column 85. The baseplate 86 can, for example, be constituted by a length of 3"×½" steel plate with spikes 193 welded to the bottom thereof being formed from cut sections of 2"×2"×¼" angle irons.

In operation, the caster 40 assembly of the lookout section 14 (FIGS. 1 and 2) is bolted at 45 to the arm 20 adjacent the post 48 by positioning the arm 20 within the groove formed between the spaced brackets 44. The back 26 of the lookout 14 is secured to the center of the top 18 of the tank 12 by connecting the metal cable 28 through the eyebolt 27 around the central post 22 (FIG. 1). The stage section 15 is then suspended from the eyebolt 38 (FIG. 2) of the lookout 14 by means of the winch 51 or other conventional vertically adjustable weight supporting device. This is accomplished with the stage 15 resting on the ground at the base of the tank 12. The column 85 (FIG. 4) of the standpipe section 16 is assembled by piecing together tubing sections 85*a*, 85*b* with bolts 88 (FIG. 5). With retaining bolt 36 (FIG. 2) removed, the upper end of the standpipe column 85 is brought within the confines of the guide channel formed by the sides 32 and pin 37 of the yoke 31 and the bolt 36 is replaced to retain the standpipe 16 therein. Similarly, with bolts 81 removed from the guide assembly 76 of the stage section 15 (FIGS. 3 and 7), the column 85 is brought between the lower and upper guide plates 78, 82 of the stage 15 and the bolts 81 are replaced to retain the standpipe 16 closedly within the confines of the vertical guide channel formed by the backplate 77, the pins 79, the bolts 81 and the plates 78, 82. The standpipe 16 is oriented relative to the yoke 31 and guide assembly 76 so that the protruding heads of the bolts 88 (FIG. 5) can pass through the central cutouts of the pins 37, 79 (FIGS. 2, 3 and 5). The base plate 86 rests against the ground with projections 93 or 193 (FIGS. 4 and 6) in ground penetrating positions to anchor the platform 10 in its circumferential travel position. For standblasting operations, nozzles 69 and hoses 70 are attached to the mounts 68 (FIG. 1), with the hoses 70 tied to the mount pins 73 and the stage flooring 78 (FIG. 3) to relieve the workers of the hose weight when they manipulate the nozzle mounts 68 to direct the sandblasting stream.

Change in the vertical position of the stage 15 is achieved by operation of the winch 51. The winch 51 is of conventional design and its manner of operation depends on the winch selected. For an air-powered motor, such as a commercially available Skyclimber TM device, up and down movement of the stage 15 can be conveniently controlled by the worker on the stage. Movement of a lever to the up or down position will cause the motor 56 to wind in or let out the cable 52 until the stage is appropriately positioned.

The stage 15 rides vertically on the standpipe 16 which remains firmly anchored to the ground adjacent the tank 12, providing stabilization to the stage 15. The suspended stage 15 is prevented from swinging outwardly away from the tank wall 24 by close fit between the guide assembly 76 and the standpipe 16 (FIGS. 3 and 5). The standpipe surface facing the tank exerts a force on the upper and lower pins 79 that counteracts the outward force generated by the pressure of the sandblasting equipment. Twisting of the stage 15 about a central vertical axis (viz. an axis coincident with the center of the standpipe shown in dot-and-dashed lines in FIG. 3) is prevented by the closeness between the square cross-section of the standpipe 16 and the slightly larger square cross-sections of the upper and lower channels formed by the guide plates 78, 82, the pins 79 and the bolts 81 (see FIG. 7). The placement of the two sandblasting nozzle mounts 68 (FIGS. 1 and 3) on rail 59 at equidistant locations from the center of the stage 15 alleviates twisting by having the forces due to the high pressure flow from one nozzle 69 counteract those due to the flow from the other nozzle 69.

The closely matching square cross-sections and the establishment of two vertically-displaced channels in the confines provided by both lower and upper guide-plates 78, 82 also prevents pivoting of the stage 15 about a horizontal axis between and parallel to the guide plates 78, 82 and about a horizontal axis between and parallel to the runners 63, 64 and the rail 59, thus stabilizing the stage against tilting of the floor 58 either forward or backward, or toward one end. The present invention thus provides a working platform with good stability.

To move the stage 15 to another position circumferentially of the tank 12, the standpipe 16 is first locked against vertical movement relative to the stage 15. This may be accomplished as illustrated in FIG. 7 by operating the winch 51 (FIG. 1) until the bore 83 on the backplate 77 of the stage 15 is aligned with a bore 96 on the standpipe 16. A pin 84 is then temporarily inserted into the two bores 83, 96 to restrain the standpipe 16 against sliding within the guide assembly 76 (FIG. 3). The winch 51 is then further operated to raise the stage 15 along with the standpipe 16, thereby also raising the pins 93 or spikes 193 (FIGS. 4 and 6) and the foot plate 86 up away from the ground. With the anchoring thus released, the arm 20 (FIGS. 1 and 2) of the lookout 14 is then rolled on the casters 40 about the rim of the tank top 18 to a new circumferential location. When the new location is reached, the standpipe 16 is lowered into penetrating contact with the ground by lowering the stage 15 using the winch 51. Pin 84 (FIG. 7) is then removed and the slide 15 is again free to ride on the anchored vertical track provided by the standpipe 16.

Figure 8:
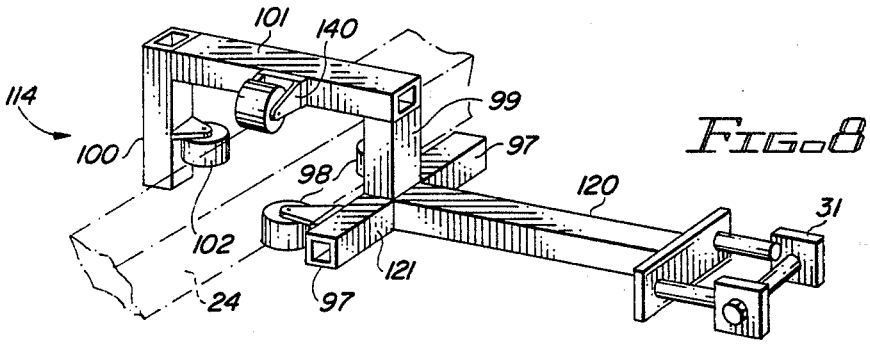
FIG. 8 is a perspective view of a modified form of the lookout of FIG. 2, for use with a tank having a floating top.

FIG. 8 illustrates a modified form 114 of the lookout section 14 of the platform 10, for use in securing the inner end of an arm 120 to the top rim of a wall 24 (shown in phantom in FIG. 8) of a tank 12 having a floating tank top 18. The configuration of yoke 31 is the same as that shown in FIG. 2 and previously described. The inner end 121 of the arm 120 is different.

A horizontal tubing piece 97 is attached to each side of arm 120 at its inner end 121, with an inwardly-directed heavy duty caster wheel 98 mounted on each piece 97. An inverted "U"-shaped frame, comprising two vertical members 99, 100 and a radially extending cross-piece 101, extends upwardly and inwardly from the inner end 121 of the arm 120. The inner vertical member 100 has an outwardly-directed caster 102 mounted thereon, and the cross-piece 101 has one or more casters 140 mounted in downwardly directed positions thereon. The casters 98 and caster 102 are positioned for rotation about vertical axes, the casters 14 are positioned for rotation about axes directed perpendicularly to the wall 24. The casters 98, 102 and 140 and elements 97, 99, 100 and 101 are relatively configured and positioned so that the platform 10 can roll around the top of the rim of the wall 24 on casters 140 for circumferential positioning of the platform 10, and the casters 98, 102 grip the inside and outside surfaces of the wall 24 to secure the arm 120 against radial and vertical movement relative to the tank 12.

As is evident from the foregoing, the invention provides a traveling worker platform having good characteristics of stabilization of a workstation stage against undesirable swinging, twisting and tilting, thereby offering significant advantages over conventional platforms and scaffolds. Although the platform of the invention has been discussed in terms of its utilization for sandblasting operations on a cylindrical fuel storage tank, it has utility for painting, welding and other operations and can also be used for noncylindrical storage tanks, and on other structures. Those skilled in the art will appreciate that the preferred embodiments of the invention described above are just examples of how the invention can be implemented, and that various substitutions and modifications may be made therein without departing from the spirit and scope of the invention as defined by the claims below.

What is claimed is:

1. A worker platform movable to a plurality of work stations about a wall of a storage tank, or the like, comprising:

a lookout arm dimensioned and configured to extend perpendicularly outward beyond a wall at the top of a tank, means for securing the inner end of said arm to said tank;

a stage;

means for suspending said stage from said arm;

roller means for supporting said arm on said tank for peripheral movement of said stage about said tank;

a standpipe;

a guide assembly located on said stage for capturing said standpipe in vertically slidable relationship to said stage;

ground anchoring means for anchoring said standpipe at the base of said tank for restraining movement of said stage relative to said wall; and means, operable by raising said stage, for releasing said anchoring means to permit said stage to be moved about said tank.

2. A worker platform as in claim 1, wherein said standpipe comprises a column, and wherein said means for anchoring said standpipe at the base of said tank comprises a plate transversely mounted to the bottom of said column, and ground penetrating means including projections extending downwardly from said plate.

3. A worker platform as in claim 2, wherein said projections are spikes formed from tapered angle irons.

4. A worker platform movable to a plurality of work stations about a wall of a storage tank, or the like, comprising:

a lookout arm dimensioned and configured to extend perpendicularly outward beyond a wall at the top of a tank, means for securing the inner end of said arm to said tank;

a stage;

means for suspending said stage from said arm;

roller means for supporting said arm on said tank for peripheral movement of said stage about said tank;

a standpipe;

ground means for anchoring said standpipe at the base of said tank for restraining movement of said stage relative to said wall; and means, operable by raising said stage, for releasing said anchoring means to permit said stage to be moved about said tank;

a first guide assembly located on said stage for capturing said standpipe in vertically slidable relationship to said stage;

a second guide assembly located on said arm for capturing said standpipe in vertically slidable relationship to said arm.

5. A worker platform, as in claim 4, further comprising means anchoring said standpipe at the base of said tank for restraining movement of said stage relative to said wall; and wherein said means for raising said standpipe comprises means operable from said stage for releasing said anchor means.

6. A worker platform as in claim 4, wherein said first guide assembly comprises vertically spaced members forming upper and lower guide channels.

7. A worker platform as in claim 4, wherein said standpipe comprises a column of square cross-section; and wherein said first guide assembly presents a similarly cross-sectioned guide channel for snuggly receiving said standpipe.

8. A worker platform as in claim 4, wherein said means for suspending said stage from said arm comprises means for suspending said stage from said arm in vertically adjustable position by means of a winch attached to said arm and said stage.

9. A worker platform as in claim 4, wherein said second guide assembly comprises a yoke at the outer end of said arm for slidably capturing said standpipe.

10. A worker platform as in claim 9, further comprising means for releasably capturing said standpipe within said guide first assembly and said yoke.

11. A worker platform as in claim 10, wherein said means for releasably capturing said standpipe within said first guide asesmbly comprises a removable outer bolt.

12. A worker platform as in claim 4, wherein said means for securing said lookout arm to said tank comprises means for connecting said arm to a central point on the top of said tank.

13. A worker platform as in claim 12, wherein said connecting means comprises a back member attached at the inner end of said arm and extending upwardly and inwardly therefrom; and an eyebolt positioned in an elevated position on said back member.

14. A worker platform as in claim 4, wherein said means for securing said lookout arm to said tank comprises means for securing said arm to the rim of the wall of said tank.

15. A worker platform as in claim 14, wherein said means for securing said arm comprises first and second wheels, means on said arm for mounting said first wheel in a position to roll along an inside surface of said wall, and means for mounting said second wheel in a position to roll along an outside surface of said wall; and wherein said roller means comprises a third wheel, and means for mounting said third wheel in a position to roll along said rim of said wall.

16. A worker platform movable to a plurality of work stations about a wall of a cylindrical storage tank, comprising:

a lookout arm dimensioned and configured to extend radially outward beyond a wall at the top of a tank;

means for securing the inner end of said arm to said tank;

a stage;

means for suspending said stage from said arm in vertically adjustable position by means of a winch attached to said arm and said stage;

wheel means for supporting said arm on said tank for circumferential movement of the outer end of said arm about said tank;

a standpipe of polygonal cross-section;

a guide assembly located on said stage and presenting upper and lower guide channels for capturing said standpipe in close fitting vertically slidable relationship to said stage;

ground anchoring means for anchoring said standpipe at the base of said tank for restraining movement of said stage relative to said wall; and means, operable by raising said stage, for releasing said anchoring means to permit said stage to be moved about said tank.

17. A worker platform as in claim 16, wherein said standpipe comprises a column of square cross-section; said guide channels are of corresponding square cross-section; and wherein said arm further comprises a yoke at its outer end presenting a yoke channel of square cross-section for also slidably capturing said standpipe.

18. A worker platform as in claim 17, wherein said column comprises a plurality of columnar sections, and insert means for interconnecting said columnar sections; said insert means comprising an insert member attached to an end of one columnar section and shaped to be brought inside and adjacently positioned end of another columnar section, and a fastener for securing said insert within said another columnar section.

19. A worker platform as in claim 18, wherein each of said cross-sections of said guide channels is formed at its inner extent by a first pin, at its outer extent by a first removable bolt, and at its sides by a pair of parallel plates; wherein said yoke channel is formed at its inner extent by a second pin, at its outer extent by a second removable bolt, and at its sides by a pair of parallel round rods; wherein said fastener has a head; and wherein said first and second pins are cut out at their centers to permit passage of said head.

20. A worker platform movable to a plurality of work stations about a wall, comprising:

an arm dimensioned and configured to extend perpendicularly outward beyond the top of a wall;

means for securing said arm against perpendicular movement relative to said wall;

a stage;

means on said stage for mounting a hose nozzle for universal movement thereon;

means for suspending said stage from said arm in vertically adjustable position spaced from said wall;

roller means for supporting said arm on said tank for movement of said stage alongside said wall;

a standpipe;

a first guide assembly located on said stage for capturing said standpipe in vertically slidable relationship to said stage; and a second guide assembly located on said arm for capturing said standpipe in vertically slidable relationship to said arm;

said standpipe cooperating with said first and second guide assemblies to stabilize said stage against swinging, twisting and tilting.

21. A worker platform as in claim 20, wherein said mounting means comprises two nozzle mounts equidistantly spaced from said guide assembly.

22. A worker platform as in claim 21, wherein each mount comprises a "U"-shaped bracket with its base rotationally attached to said stage, a pin connected across the upwardly extending sides of said bracket, and a tubing section pivotally attached to said pin.

* * * * *